US006422678B1

(12) United States Patent
Serra et al.

(10) Patent No.: US 6,422,678 B1
(45) Date of Patent: Jul. 23, 2002

(54) METHOD AND APPARATUS FOR ALIGNING STAGGERED PENS USING A COMPOSITE REFERENCE

(75) Inventors: Josep Maria Serra; Antoni Murcia, both of San Diego, CA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/918,776

(22) Filed: Jul. 30, 2001

(51) Int. Cl.[7] ..... B41J 29/393; B41J 2/145; B41J 2/15

(52) U.S. Cl. ..... 347/19; 347/40

(58) Field of Search ..... 347/19, 40, 23

(56) References Cited

U.S. PATENT DOCUMENTS 5,387,976 A * 2/1995 Lesniak ..... 347/19
6,241,334 B1 * 6/2001 Haselby ..... 347/19

* cited by examiner

*Primary Examiner*—Thinh Nguyen

(57) ABSTRACT

In accordance with an embodiment of the invention, a method of aligning multiple staggered pens in a printer includes printing a series of test block patterns, the test block patterns containing a plurality of composite references printed with a set of pens from at least two rows of a pen arrangement of the printer and a plurality of alignment blocks. The method further includes measuring relative distances between the plurality of composite references and the plurality of alignment blocks to determine a per-pen misalignment and modifying pen operation to compensate for the per pen misalignment.

25 Claims, 4 Drawing Sheets

METHOD AND APPARATUS FOR ALIGNING STAGGERED PENS USING A COMPOSITE REFERENCE

FIELD OF THE INVENTION

The present invention relates generally to multi-pen printers, and, more specifically, to alignment of staggered pens in multi-pen printers.

BACKGROUND OF THE INVENTION

Printers with multiple printheads, or pens, such as ink jet printers, for example, have historically had aligned pens. In this context, aligned means that the pens are substantially aligned in a scan axis. A scan axis is the path along which the pens, typically transported by a carriage, may travel when the printer is in operation. In such printers, aligning the printheads, or, more specifically, what the pens print on a media, is typically accomplished by using one pen as a reference and then aligning the other pens relative to that reference.

One advance in print technology is the use of staggered pens. Printers with staggered pens may have certain advantages over printers with non-staggered pens, such as improved print quality and/or improved print speed. However, conventional methods for aligning pens in printers with staggered pens may have certain disadvantages. For example, using one pen as a reference and aligning the other pens to that reference may introduce errors into the alignment of such pens due to, for example, media advance errors, though other sources of error may exist. Therefore, alternative techniques for aligning staggered pens in multi-pen printers are desirable.

SUMMARY OF THE INVENTION

In accordance with an embodiment of the invention, a method of aligning multiple staggered pens in a printer includes printing a series of test block patterns, the test block patterns containing a plurality of composite references printed with a set of pens from at least two rows of a pen arrangement of the printer and a plurality of alignment blocks. The method further includes measuring relative distances between the plurality of composite references and the plurality of alignment blocks to determine a misalignment per pen and modifying pen operation to compensate for the per pen misalignment.

DETAILED DESCRIPTION OF THE INVENTION

Figure 1:
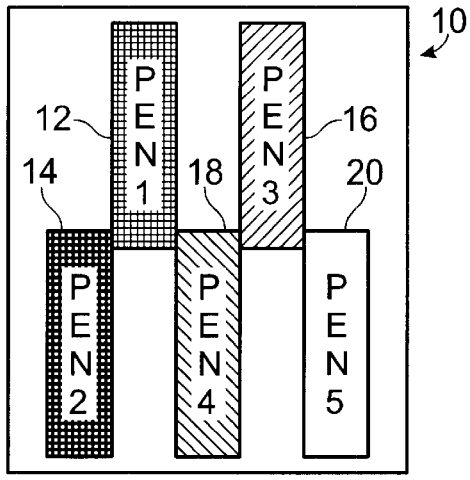
FIG. 1 is a high level schematic drawing illustrating a multi-pen staggered pen arrangement that may be employed in accordance with an embodiment of the invention.

Referring first to FIG. 1, a multiple staggered pen arrangement 10 is illustrated in a high level schematic drawing. This pen arrangement depicts five pens, designated 12 (PEN1), 14 (PEN2), 16 (PEN3), 18 (PEN4) and 20 (PEN5), though the invention is not limited to this particular arrangement nor any particular number or combination of pens. For pen arrangement 10, the five pens would typically include a combination of black pens and color pens. For example PEN1 and PEN2 may be black pens, while pens PEN3, PEN4 and PEN5 may be, respectively, yellow, cyan and magenta pens, though other arrangements are possible. The shading indicated for these pens in FIG. 1 is consistent throughout the figures for those pens, and for blocks indicated as being printed by the respective pens.

For the pen arrangement 10 illustrated in FIG. 1, the pens are oriented in what may be termed a partially staggered arrangement. Partially staggered, in this context, means that there is some vertical overlap between the pens. Such an overlap may have certain advantages for alignment of such pens, as is discussed in more detail hereafter. Other pen arrangements are, of course possible. For example, a totally staggered arrangement may be employed where no overlap between pens exist. The particular arrangement of pens will depend, at least in part, on the particular embodiment.

Figure 2:
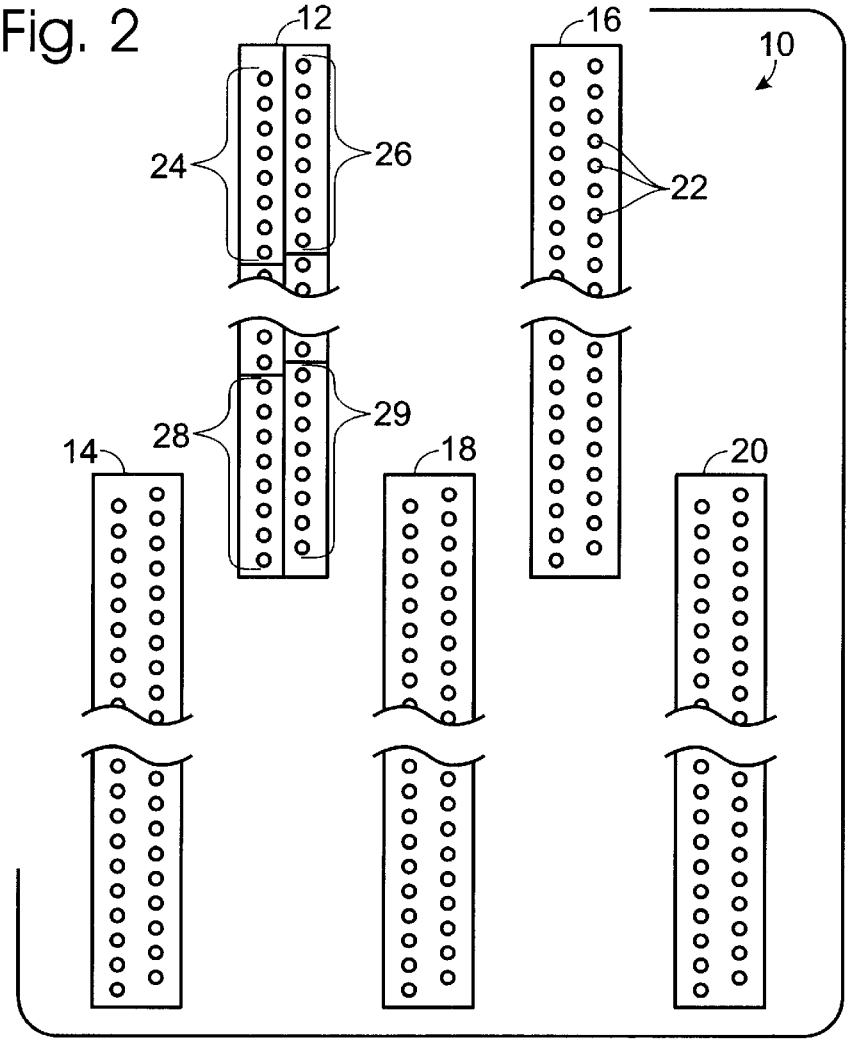
FIG. 2 is a more detailed schematic drawing of the staggered pen arrangement illustrated in FIG. 1, illustrating a nozzle arrangement of the pens.

FIG. 2 illustrates a more detailed schematic view of pen arrangement 10. The pens shown in FIG. 2 include a plurality of nozzles 22, such as pens employed in inkjet printers, for example. The arrangement shown in FIG. 2 is substantially similar to that shown in FIG. 1. The spacing of the pens in FIG. 2 is illustrative of the fact that such pens would, in operation, normally be housed in a carriage.

As was indicated with respect to FIG. 1, the pens in FIG. 2 are shown in a partially staggered arrangement. In such an arrangement, there is overlap of the pens in one row of the pen arrangement with the pens in an adjacent row of the pen arrangement. In this regard, the pen arrangement shown in FIG. 2 includes two rows. A first row includes pen 12 (PEN1) and pen 16 (PEN3), and a second row includes pens pen 14 (PEN2), pen 18 (PEN4) and pen 20 (PEN5). This arrangement results in overlap between the nozzles of adjacent rows of such a pen arrangement. As was indicated above, such an arrangement may have certain advantages, which are discussed below.

The pens depicted in FIG. 2 are shown with an illustrative break, as such pens may include various numbers of nozzles. For example, pens with 500 or more nozzles may be employed in such an arrangement. For purpose of this discussion, though the invention is not so limited, pens with 524 nozzles will be discussed. For such pens, only a portion of the 524 nozzles per pen is typically used in operation. For example, 512 nozzles may be active while 12 nozzles are inactive. This is advantageous as, in a partially staggered configuration, it may allow for alignment of such pens relative to one another by modifying the active nozzles of one or more pens. Because, in this scenario, 12 nozzles per pen may be inactive, this would allow for changing the active nozzles to align what each pen prints relative to the others. For example, if pen 12 were, initially, to have 4 inactive nozzles at the top of the pen and 8 inactive 10 nozzles at the bottom of the pen, that pen may be adjusted as many as 4 nozzles "up" or as many as 8 nozzles "down", assuming that 512 contiguous nozzles remain active.

For embodiments in accordance with the invention, such nozzles may also be grouped into sets, or what may be termed "logical primitives", such as those shown at 24, 26, 28 and 29. The number of nozzles in such a logical primitive may vary and will depend, at least in part, on the particular embodiment. In this regard, a logical primitive may include a single nozzle, or may include an entire column of nozzles of a pen. While illustrated with eight nozzles per logical primitive in FIG. 2, typically, for a pen having 524 nozzles, a logical primitive may include, for example, thirty-two nozzles. The groupings of one column of nozzles may also be treated as a first set of logical primitives and the groupings of the other column of nozzles as a second set of logical primitives. Such grouping of nozzles may be advantageous as each logical primitive may be aligned as a group. Such an approach may, in turn, simplify the alignment of such pens, as nozzles would not be aligned individually using such a technique. In this regard, individual alignment of nozzles may be relatively complex. Likewise, aligning the pens as a whole, without such groupings, or with an entire column as a grouping, may not result in acceptable alignment due to variations across each pen. Therefore, grouping nozzles in this manner may allow for trading off between precision of alignment and simplification of alignment.

Figure 3:
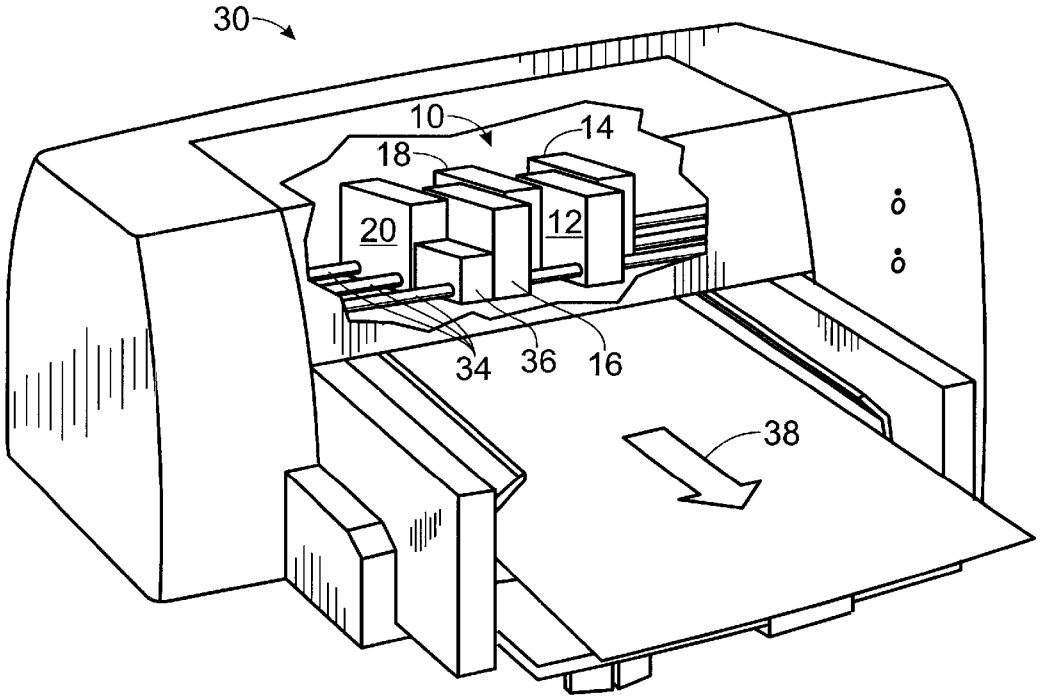
FIG. 3 is a drawing illustrating a printer employing a pen alignment system in accordance with an embodiment of the invention.

FIG. 3 illustrates a printer 30 employing a pen alignment system in accordance with the invention. The pen alignment system includes a printer 30 shown in an isometric, partial sectional view. The printer includes sensor 36, which may be coupled with a pen carriage. Such sensors are known, and may be employed to scan test block patterns to determine relative distances between the various components of such patterns by sensing the patterns and/or edges of those patterns. Alternatively, a separate sensor not included in the printer may be used. Printer 30 employs a staggered pen arrangement 10, such as illustrated in FIGS. 1 and 2. For simplicity of illustration, the pen arrangement is shown without a carriage, which would typically house such pens. The carriage may, in operation, travel along a scan axis of the printer on rod set 34, which substantially defines the scan axis. The print media would typically travel along a media advance axis, such as in the direction indicated by arrow 38. The invention is, of course, not limited to the use of any particular printer or sensor, and many possible alternatives exist.

Figure 4:
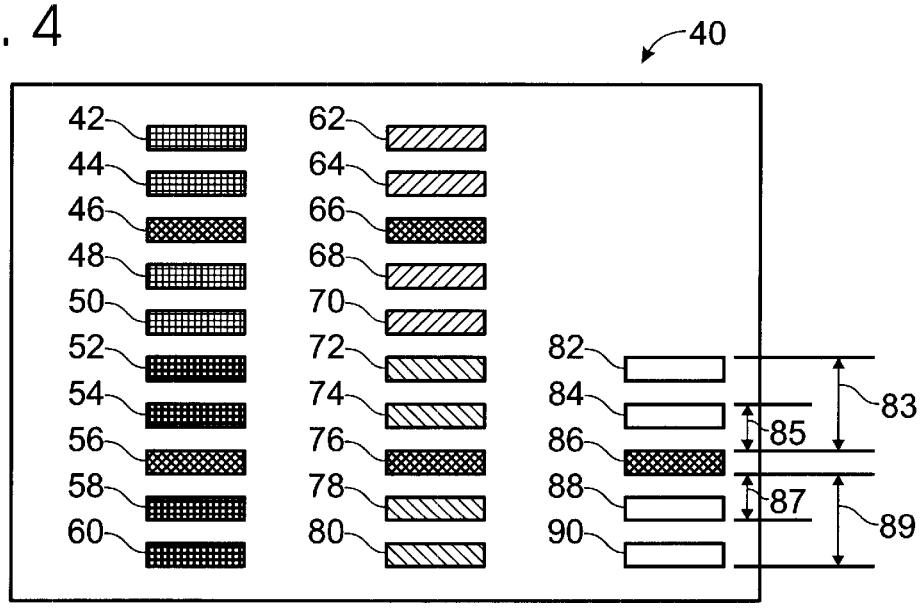
FIG. 4 is a drawing illustrating an embodiment of a test block pattern that may be employed to align staggered pens in a media advance axis in accordance with an embodiment of the invention.

FIG. 4 illustrates a test block pattern 40 in accordance with the invention that may be employed to align staggered pens in a media advance axis. In this regard, pattern 40 includes a plurality of composite references 46, 56, 66, 76 and 86. In this regard, a composite reference may be printed with a combination of pens from pen arrangement 10. For example, though not limiting, composite references 46, 56, 66, 76 and 86 may be printed with all five pens of pen arrangement 10. As one alternative, the composite references may be printed with one or more pens from each row of pen arrangement 10, such as with PEN3 (16) and PEN5 (20). For printers having more than two rows of pens, a composite reference may be printed with pens from all rows or some subset of the rows.

As was indicated above, for printers with aligned pens, typically one pen is used as a reference and the remaining pens are aligned relative to that reference. However, for staggered pen arrangements, such as pen arrangement 10, using a single pen as a reference may not account for errors such as media advance errors while use of a composite reference may take into account such errors.

Printing the composite references with pens from multiple rows of pen arrangement 10 will take into account the effects of errors due to, for example, media advance and may allow compensation for such errors. In this context, compensating for such errors means, that because those errors would typically be present in the composite reference, such errors, therefore, would be accounted for in the measurement of the relative distances between composite references and alignment blocks. Since such measurements are typically compared to expected values and with each other, such errors will be also be comprehended in those comparisons. In contrast, using a single pen as a reference would typically not reflect any such errors in the reference. Therefore, such errors would not be accounted for in the measurement of relative distances between the single-pen references and associated alignment blocks, nor compensated for as part of the alignment process.

Test block pattern 40, illustrated in FIG. 4, also includes a plurality of alignment blocks printed with the individual pens of pen arrangement 10. For the composite references and the alignment blocks, these would typically be printed with a predetermined subset of active nozzles of the pens of pen arrangement 10. The predetermined subset of nozzles may or may not correspond with the logical primitive groupings discussed earlier.

While alignment may be accomplished with a single alignment block, the use of multiple alignment blocks typically improves alignment accuracy. Also, printing multiple alignment blocks may allow for the determination of a pen "width" or pad factor. In this context, pad factor is the printable swath of a given pen compared to a target swath, based on, at least in part, typical nozzle spacing. Pad factor may be useful for determining, for example, any adjustments to media advance that may be desired to reduce, for example, banding that may occur from advancing the print media more than the pen "width."

Looking at the leftmost column in FIG. 4, alignment blocks 42, 44, 48 and 50 are printed by pen 12 (PEN1) and oriented on either side of composite reference 46. Likewise, alignment blocks 52, 54, 58 and 60 are printed with pen 14 (PEN2) and oriented on either side of composite reference 56. Such an arrangement may allow for alignment of pen 12 (PEN1) and pen 14 (PEN2) in the media advance axis.

In this regard, by scanning the leftmost column in FIG. 4 with sensor 36 in the media advance axis, relative distances between the composite references and the alignment blocks may be measured. Examples of such distances are shown for pen 20 (PEN5) at 83, 85, 87 and 89. Similar, and other, distances may be measured for each of the pens. Since the composite references are printed with pens of multiple rows, errors due to media advance are accounted for in such measurements. Based on these measurements, adjustments to operation of the pens may be made to compensate, at least in part, for any misalignment due to such errors. For example, a misalignment of pen 12 (PEN1) to composite reference 46 may be determined. In this regard, it may be determined that pen 12 (PEN1) is printing alignment marks 42 and 44 at a distance above composite reference 46 that is greater than the distance below composite reference 46 that pen 12 (PEN1) is printing alignment marks 48 and 50. Accordingly, the set of active nozzles for pen 12 (PEN1) may be adjusted to compensate, at least in part, for such misalignment. Such adjustments are discussed in more detail hereinafter.

Alignment of pen 14 (PEN2) with composite reference 56 may be accomplished in a substantially similar manner as pen 12 (PEN1) with composite reference 46 by employing alignment blocks 52, 54, 58 and 60 and sensor 36. Additionally, alignment of pen 12 (PEN1) with pen 14 (PEN2) may be accomplished by measuring relative distances between the alignment blocks associated with each pen to one another. Similarly, adjustments to active nozzles for one, or both pens, may be made to account for alignment of the pens to their respective composite references as well as their alignment one to another.

As previously indicated, such a technique may for errors associated with, for example, media advance. The remaining pens, pen 16 (PEN3), pen 18 (PEN4) and pen 20 (PEN5) may also be aligned in a substantially similar manner as has been discussed with regard to pen 12 (PEN1) and pen 14 (PEN2). Pen 20 (PENS), however, does not have a partner pen and, therefore, would typically be aligned only with respect to composite reference 86 in the media advance axis.

Figure 5:
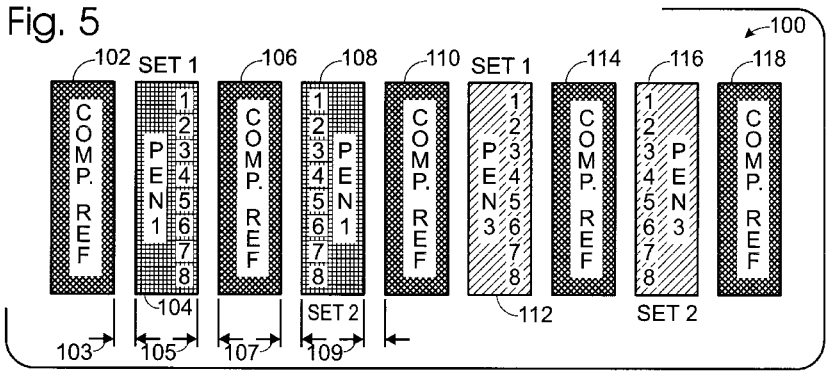
FIGS. 5–6 are drawings illustrating embodiments of test block patterns that may be employed to align staggered pens in a scan axis in accordance with an embodiment of the invention.
Figure 6:
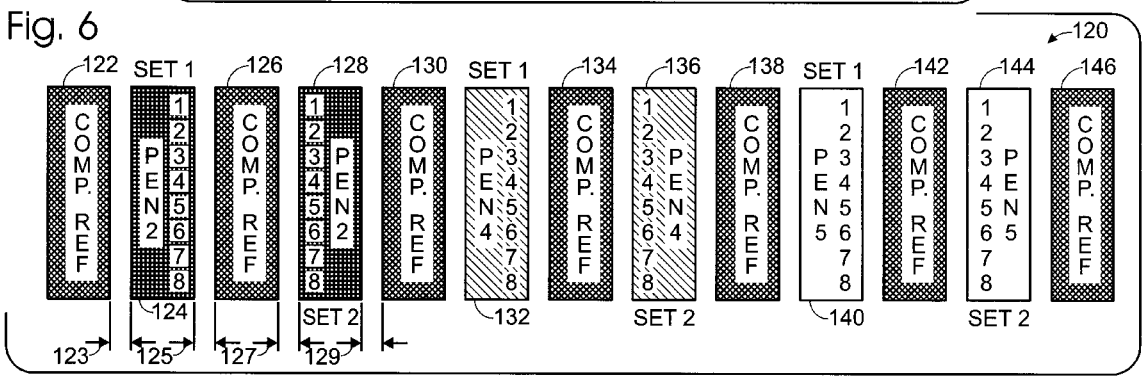

FIGS. 5 and 6 illustrate test block patterns that may be employed to align the pens of a staggered pen arrangement, such as pen arrangement 10, in a scan axis. As previously indicated, a scan axis is typically the axis along which a pen carriage, and associated pens, travels during operation of a printer, such as printer 30. In this regard, test block pattern 100 illustrated in FIG. 5 may be employed to align the row of pen arrangement 10 including pen 12 (PEN1) and pen 16 (PEN3) in the scan axis. Likewise, test block pattern 120 illustrated in FIG. 6 may be employed to align the row of pen arrangement 10 including pen 14 (PEN2), PEN3 18 and pen 20 (PENS) in the scan axis.

Referring to FIG. 5, a plurality of composite references, 102, 106, 110, 114 and 118, are printed in a similar manner as was discussed above with regard to FIG. 4. In this respect, the composite references, for example, may be printed with pens from both rows of pen arrangement 10, so as to account for the effects of any errors associated with, for example, media advance.

Test block pattern 100 also includes two alignment blocks per pen, printed in an interspersed arrangement with the composite references. For example, pen 12 (PEN1) may print alignment blocks 104 and 108. For this embodiment, alignment block 104, as indicated, may be printed with a first set of nozzles, while alignment block 108 may be printed with a second set of nozzles. Alternatively, for example, a pen with a single column of nozzles may print only one such alignment block using such technique. These sets of nozzles typically correspond to the sets of logical primitives of each column of a pen, such as pen 12 (PEN1) and are indicated as 1–8 for each alignment block in FIG. 5. The first set may include the logical primitives of the rightmost column of nozzles of the pen, while the second set may include the logical primitives of the leftmost column of nozzles of the pen, though the invention is not so limited, and grouping sets of nozzles may be done in alternative ways.

Each logical primitive may then be aligned with the composite references, such as 102, 106 and 108, in the scan axis. This may be done as the height of each logical primitive is substantially predetermined and the portion of each alignment block 104 and 108 associated with each logical primitive may be compared to the composite reference by employing, for example, sensor 36. Such a comparison may include measuring distances for each logical primitive to the composite references such as those indicated at 103, 105, 107 and 109. Any misalignment in the scan axis determined from these measurements would take into account errors associated with media advance and may be compensated for, at least in part, by adjusting firing times for the nozzles of each logical primitive. In this respect, depending on the misalignment, the firing times may be adjusted to fire the nozzles earlier or later. Various techniques for implementing such adjustments exist, such as employing software or firmware, and the invention is not limited in scope to any particular method or technique.

Alignment of the remaining pens illustrated in FIGS. 5 and 6; pen 14 (PEN2), pen 16 (PEN3), PEN4 19 and pen 20 (PEN5), may be accomplished in a substantially similar manner as discussed with regard to pen 12 (PEN1). Such alignment may employ measuring distances for each logical primitive such as those indicated at 123, 125, 127 and 129 and will not be discussed further here in the interest of brevity.

Figure 7:
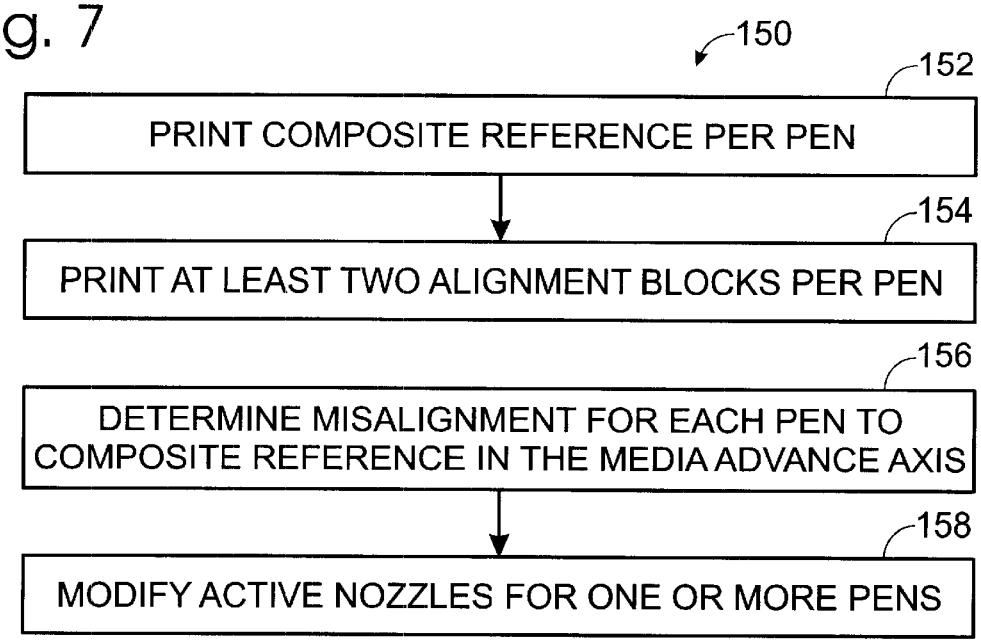
FIG. 7 is a flowchart illustrating a method for aligning staggered pens in a media advance axis in accordance with an embodiment of the invention.

FIG. 7 is a flowchart 150 illustrating a method in accordance with the invention for aligning multiple staggered pens in a printer in a media advance axis. Such a method may employ a test block pattern such as test block pattern 40, illustrated in FIG. 4. For this embodiment, a printer, such as printer 30 prints a composite reference per pen of the printer at 152. At 154, two alignment blocks per pen are printed.

For method 150, such alignment blocks would typically be oriented on either side of a respective composite reference and arranged vertically in the media advance axis. At 156, by employing sensor 36, any misalignment of the pens may be determined by measuring relative distances of the alignment blocks to the respective composite references and then comparing those distances with each other and with expected values. Any determined misalignment may be, at least in part, compensated for by modifying the active nozzles of one or more pens of a pen arrangement at 158. Various techniques for implementing such a change in active nozzles exist and the invention is not limited to any particular technique. As was previously indicated with respect to nozzle firing times, such techniques may include software or firmware implementation.

Figure 8:
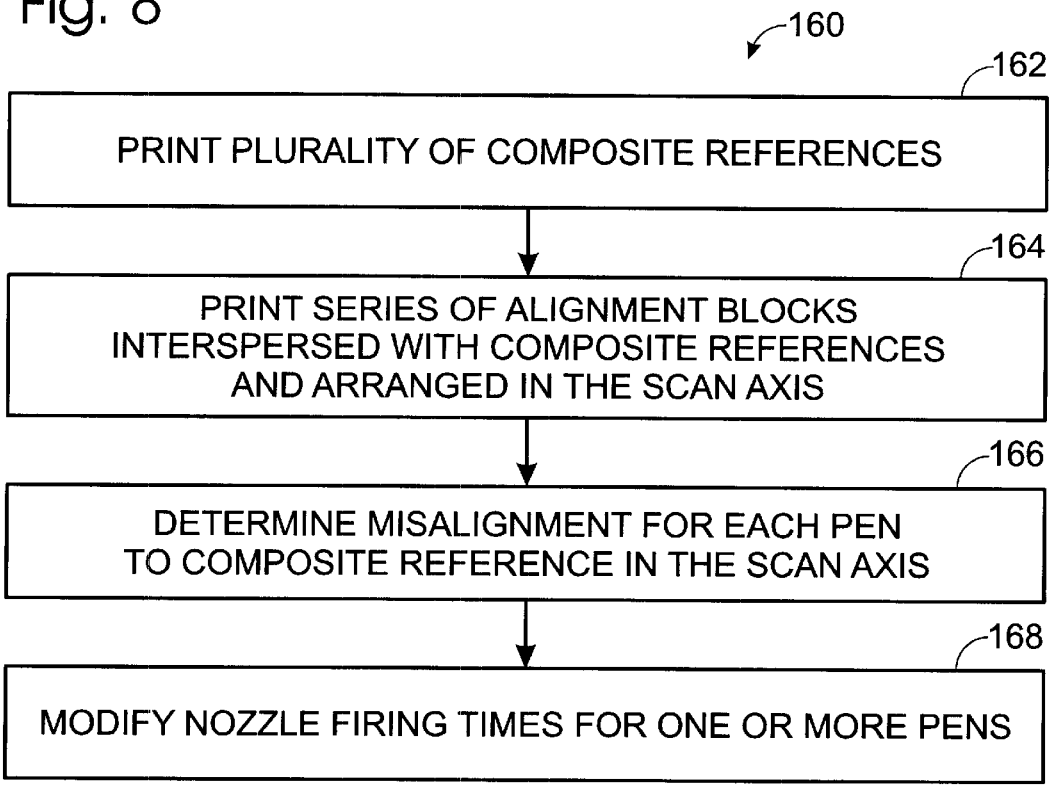
FIG. 8 is a flowchart illustrating a method for aligning staggered pens in a scan axis in accordance with an embodiment of the invention.

FIG. 8 is a flowchart 160 illustrating a method for aligning multiple staggered pens of a printer in a scan axis. Such a method may employ test block patterns, such as those illustrated in FIGS. 5 and 6, as were previously discussed. For this embodiment a plurality of composite references are printed at 162. At 164, a series of alignment blocks are printed in an interspersed pattern with the composite references and arranged along the scan axis. A misalignment per pen, such as by logical primitive, for example, is determined at 166. Such misalignments may be determined by employing sensor 36 to measure relative distances and comparing those distances with each other and with expected values, as has been previously discussed. At 168, the determined misalignment per pen may be compensated for, at least in part, by modifying nozzle firing times for at least one pen, as has also been previously discussed.

While the present invention has been particularly shown and described with reference to the foregoing depicted embodiments, those skilled in the art will understand that many variations may be made therein without departing from the spirit and scope of the invention as defined in the following claims. The description of the invention should be understood to include all novel and non-obvious combinations of elements described herein, and claims may be presented in this or a later application to any novel and non-obvious combination of these elements. The foregoing embodiments are illustrative, and no single feature or element is essential to all possible combinations that may be claimed in this or a later application. Where the claims recite "a" or "a first" element or the equivalent thereof, such claims should be understood to include incorporation of one or more such elements, neither requiring nor excluding two or more such elements.

We claim:

1. A method of aligning multiple staggered pens in a printer comprising:

printing a series of test block patterns, the test block patterns including a plurality of composite references printed with a set of pens from at least two rows of a pen arrangement of the printer and a plurality of alignment blocks;

measuring relative distances between the plurality of composite references and the plurality of alignment blocks to determine a per-pen misalignment;

modifying pen operation to compensate for the per-pen misalignment.

2. The method of claim 1, wherein determining the per-pen misalignment includes determining a first misalignment in a media advance axis and determining a second misalignment in a scan axis.

3. The method of claim 2, wherein modifying pen operation includes modifying a set of active nozzles of at least one pen to compensate for the first misalignment in the media advance axis.

4. The method of claim 2, wherein modifying pen operation includes modifying nozzle firing times of at least one pen to compensate for the second misalignment in the scan axis.

5. A method of aligning multiple staggered pens in a printer in a media advance axis comprising:

printing at least one composite reference;

printing at least one alignment block for each pen of the printer, each alignment block being associated with a corresponding composite reference;

measuring relative distances between each alignment block and the corresponding composite reference;

determining for each pen, a misalignment with the corresponding composite reference in the media advance axis based on the relative distances between the alignment block and the corresponding composite reference; and modifying a set of active nozzles for at least one pen of the printer to compensate for the misalignment in the media advance axis.

6. The method of claim 5, wherein printing the corresponding composite reference includes directing the printer to print a pattern with at least one pen per row of a staggered pen arrangement of the printer.

7. The method of claim 5, wherein printing the corresponding composite reference includes directing the printer to print a pattern with at least one pen of each of at least two rows of a staggered pen arrangement of the printer.

8. The method of claim 5, wherein printing the corresponding composite reference includes directing the printer to print a pattern with all pens of the printer.

9. The method of claim 8, wherein the pattern includes a plurality of geometric shapes arranged in at least one column corresponding with the media advance axis and at least one row corresponding with a scan axis.

10. The method of claim 5, wherein measuring the relative distances includes scanning the alignment block and the corresponding composite reference in the media advance axis with a sensor.

11. A method of aligning multiple staggered pens in a printer in a scan axis comprising:

printing at least one composite reference;

printing a series of alignment blocks in a pattern with the staggered pens of the printer, each alignment block of the series being nominally aligned with a corresponding composite reference;

measuring relative distances between each alignment block and the corresponding composite reference to determine a misalignment between the alignment block and the corresponding composite reference in the scan axis; and adjusting nozzle firing times to compensate, for the misalignment in the scan axis.

12. The method of claim 11, wherein printing the corresponding composite reference includes directing the printer to print the composite reference with at least two pens, the at least two pens being from each of at least two rows of a pen arrangement of the printer.

13. The method of claim 11, wherein printing the corresponding composite reference includes directing the printer to print the composite reference with at least one pen per row of a staggered pen arrangement of the printer.

14. The method of claim 11, wherein printing the corresponding composite reference includes directing the printer to print the composite reference with all pens of the printer.

15. The method of claim 11, wherein printing the series of alignment blocks with the pens of the printer includes directing the printer to print a first and second alignment blocks with each pen of the printer, wherein the first alignment block is printed with a first set of nozzle groupings and the second alignment block is printed with a second set of nozzle groupings.

16. The method of claim 15, wherein the first and second alignment blocks are printed on opposing sides of a first corresponding composite reference and substantially adjacent, respectively, to second and third corresponding composite references.

17. The method of claim 16, wherein the first and second alignment blocks, the first corresponding composite reference, and the second and third corresponding composite references are substantially rectangular and nominally aligned in the scan axis.

18. The method of claim 11, wherein determining a misalignment includes scanning the series of alignment blocks and the corresponding composite reference in the scan axis by employing a sensor, comparing these relative distances to expected distances to determine a firing time offset per nozzle grouping of a set of nozzle groupings per pen, and applying the firing time offsets to the printer when in operation.

19. A pen alignment system comprising:

a printer including multiple staggered pens disposed in at least two rows of a pen arrangement, the pens having a plurality of nozzles configured to print a test block pattern, the test block pattern including, for each pen, a composite reference printed with a subset of the pens and an alignment block, the test block pattern being arranged to allow determination of a misalignment between the pens in a media advance axis; and a sensor for scanning the test block pattern to measure distances between the composite reference and the alignment block for each pen to determine misalignment for each pen in the media advance axis.

20. The pen alignment system of claim 19, wherein the printer is configured to print the composite reference for each pen with at least one pen per row of the staggered pen arrangement of the printer.

21. The pen alignment system of claim 19, wherein the pens are further configured to print a second test block pattern, the second test block pattern including a plurality of other composite references printed with a subset of the pens and at least two alignment blocks per pen, the second test block pattern being arranged so as to allow determination of a misalignment between the pens in a scan axis via, the sensor being configured to determine relative distances between the plurality of other composite references and the at least two alignment blocks per pen in the scan axis by scanning in the scan axis.

22. An article comprising:

a storage medium having a plurality of machine-readable instructions, wherein when the instructions are executed, the instructions provide for:

printing a series of test block patterns, the test block patterns including a plurality of composite references printed with a set of pens from at least two rows of a staggered pen arrangement of a printer and a plurality of alignment blocks;

measuring relative distances between the plurality of composite references and the plurality of alignment blocks to determine a per-pen misalignment;

modifying pen operation to compensate for, at least in part, the per-pen misalignment.

23. The article of claim 22, wherein determining the per-pen misalignment includes determining a first misalignment in a media advance axis and determining a second misalignment in a scan axis.

24. The article of claim 23, wherein modifying pen operation includes modifying a set of active nozzles of at least one pen to compensate for the first misalignment in the media advance axis.

25. The article of claim 23, wherein modifying pen operation includes modifying nozzle firing times of at least one pen to compensate for the second misalignment in the scan axis.

* * * * *